US007105204B2

(12) United States Patent
Betteridge

(10) Patent No.: US 7,105,204 B2
(45) Date of Patent: Sep. 12, 2006

(54) APPARATUS AND METHOD FOR COATING THE EXTERIOR SURFACE OF A PIPE

(76) Inventor: John W. Betteridge, The Cottage 3 Station Road, Tollshunt D'Arcy, Essex CM9 8TQ (GB)

( * ) Notice: Subject to any disclaimer, the term of this patent is extended or adjusted under 35 U.S.C. 154(b) by 644 days.

(21) Appl. No.: 10/018,511

(22) PCT Filed: May 17, 2001

(86) PCT No.: PCT/GB01/02189

§ 371 (c)(1),
(2), (4) Date: Dec. 14, 2001

(87) PCT Pub. No.: WO01/89710

PCT Pub. Date: Nov. 29, 2001

(65) Prior Publication Data

US 2005/0013941 A1 Jan. 20, 2005

(51) Int. Cl.
*B05D 1/02* (2006.01)

(52) U.S. Cl. ..... 427/427.3; 427/421.1; 427/181; 118/313; 118/323; 118/315

(58) Field of Classification Search ..... 118/DIG. 11, 118/DIG. 13, 305, 308, 315, 319; 427/421.1, 427/427.1, 427.3, 182, 181
See application file for complete search history.

(56) References Cited

U.S. PATENT DOCUMENTS

| | | | | |
|---|---|---|---|---|
| 2,357,144 A | | 8/1944 | Stair | 91/45 |
| 3,208,868 A | | 9/1965 | Strobel et al. | 117/18 |
| 4,595,607 A | * | 6/1986 | Betteridge et al. | 427/185 |
| 5,026,451 A | * | 6/1991 | Trzecieski et al. | 156/244.27 |
| 5,191,740 A | * | 3/1993 | Rose | 451/92 |
| 5,207,833 A | | 5/1993 | Hart | 118/307 |
| 5,725,668 A | | 3/1998 | Foster et al. | 118/411 |

FOREIGN PATENT DOCUMENTS

| | | | |
|---|---|---|---|
| GB | 1009055 | | 11/1965 |
| GB | 2 233 253 | | 1/1991 |
| GB | 2 285 592 | | 7/1995 |
| GB | 2285592 A | * | 7/1995 |

OTHER PUBLICATIONS

"Sprays". Kirk-Othmer. Encyclopedia of Chemical Technology. 4th Ed. vol. 22. pp. 687-688.*
"Coating Processes". Kirk-Othmer. Encyclopedia of Chemical Technology. 4th Ed. vol. 6. pp. 661-667.*

* cited by examiner

*Primary Examiner*—Timothy Meeks
*Assistant Examiner*—David Turocy
(74) *Attorney, Agent, or Firm*—Philip O. Post

(57) ABSTRACT

The exterior surface of a pipe is coated around its full perimeter without rotation of the pipe or the complete coating apparatus. In one example, the coating apparatus includes coating heads attached to a rotor with the coating material supplied under positive air pressure via a stator. The coating heads rotate with the rotor and eject coating material onto the exterior surface of the pipe. In a second example, the coating apparatus is stationary and coating material is delivered under positive air pressure though chambers within the apparatus.

25 Claims, 3 Drawing Sheets

APPARATUS AND METHOD FOR COATING THE EXTERIOR SURFACE OF A PIPE

BACKGROUND OF THE INVENTION

1. Field of the Invention

The present invention relates to the application of a coating material to the outer surface of a pipe wherein neither the pipe nor the entire coating apparatus need be rotated to accomplish a coating around a complete circumferential area of the pipe.

2. Description of Related Art

Pipelines laid overland or under water are assembled from generally cylindrical sections of hollow pipe that are suitably joined together. A typical section that is used to fabricate an oil or gas pipeline has a length of approximately 20 metres and an outside diameter ranging from approximately 1 to 20 metres. A suitable joining process, such as welding, is used to join the pipe sections together. Each section of pipe is manufactured with an exterior coating that typically consists of an inner protective coating layer and an outer insulative layer. The protective layer, with a typical thickness of 1 mm, is formed by rotating the section of pipe whilst the material is applied to the pipe. A suitable composition is a fusion-bonded thermoplastic powder with an epoxy, polypropylene or polyethylene base that is applied to a pre-heated rotating section of pipe. The insulative layer, with a thickness generally on the order of 50 to 60 mm, is typically applied by an extrusion process. In order to join sections together, the insulative and protective coating layers must be cut or stripped back from each end of a section to expose the pipe material for the joining process. After the joining is completed, the exterior coating must be restored in the field to ensure integral coating of the pipeline. When a thermoplastic material is used, the coating material, in powdered form, is applied to the exterior of a pipe that has been preheated to achieve fusion of the material when it comes in contact with the pipe. For ferrous pipes, heating is generally accomplished by magnetic induction. Prior art processes and apparatus for accomplishing this task are disclosed in U.S. Pat. No. 4,595,607. An adhesive material, which can be a polypropylene-based composition, is normally applied over the protective coating by a similar process. Finally, the thicker insulative material is laid over the adhesive by an extrusion process.

Exterior protective coating of an entire pipe may be accomplished by an electrostatic process in which a pipe that has an induced charge on its surface is rotated over a coating material having an opposing charge.

A disadvantage of the prior art is that either the entire coating apparatus or the pipe must be rotated to achieve a full 360-degree coating of an area around the outer perimeter of the pipe.

Therefore, there exists the need for apparatus and method that can apply a 360-degree perimetrical band of coating material to the exterior surface of a pipe without rotating either the pipe or the coating apparatus.

An object of the present invention is to provide apparatus and method for applying a coating material around the complete perimeter of the exterior of a pipe without rotating the pipe or all components of the coating device. An outer stationary or stator element remains static whilst an inner rotor element is used to achieve a 360-degree perimetrical coating.

Another object of the present invention is to provide apparatus and method for applying a coating material around the complete perimeter of the exterior of a pipe without rotating the pipe or the coating device. The entire coating device remains stationary whilst a 360-degree perimetrical coating of the pipe is achieved.

BRIEF SUMMARY OF THE INVENTION

In its broad aspects, the present invention is an apparatus and method for application of coating material to the exterior surface of a pipe. The apparatus surrounds the exterior surface of the pipe and comprises a stationary component or stator, and a rotating component, or rotor. The rotor is located within the stator and is free to rotate around the pipe relative to the fixed stator. The rotor comprises at least one internal gallery or enclosed passage that extends substantially around the rotor. One or more coating heads are attached to the rotor. Each coating head has an internal passage that is connected to the gallery and an opening for ejecting the coating material onto the exterior surface of the pipe. The coating material is supplied from an external source to the gallery. Positive air pressure is maintained within the gallery to force the coating material out of the opening in the coating head.

In another aspect, the present invention is an apparatus and method wherein the pipe and entire coating apparatus remains stationary whilst a complete circumferential area on the exterior of the pipe is coated. Coating material is supplied at a positive air pressure into a compression chamber within a substantially annular body of the coating apparatus. The compression chamber is substantially continuous around an inner radius of the body. Air pressure forces the coating material through the compression chamber and into one or more diffusing chambers, which are also within the body of the coating apparatus and are substantially continuous around an inner radius of the body. Coating material exits the diffusing chambers into a gallery on the inner side of the annular body. An interchangeable centre section is positioned against the gallery. The centre section has one or more openings in it to eject coating material from the galley and onto the exterior surface of the pipe.

These and other aspects of the invention will be apparent from the following description.

BRIEF DESCRIPTION OF THE SEVERAL VIEWS OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 5:
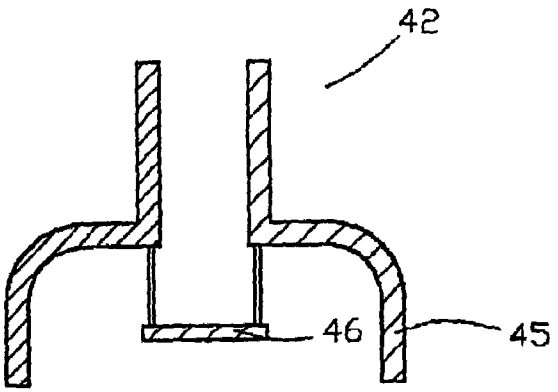
FIG. 5 is a cross-sectional view of one example of a coating head used with the coating apparatus shown in FIG. 1.
Figure 1:
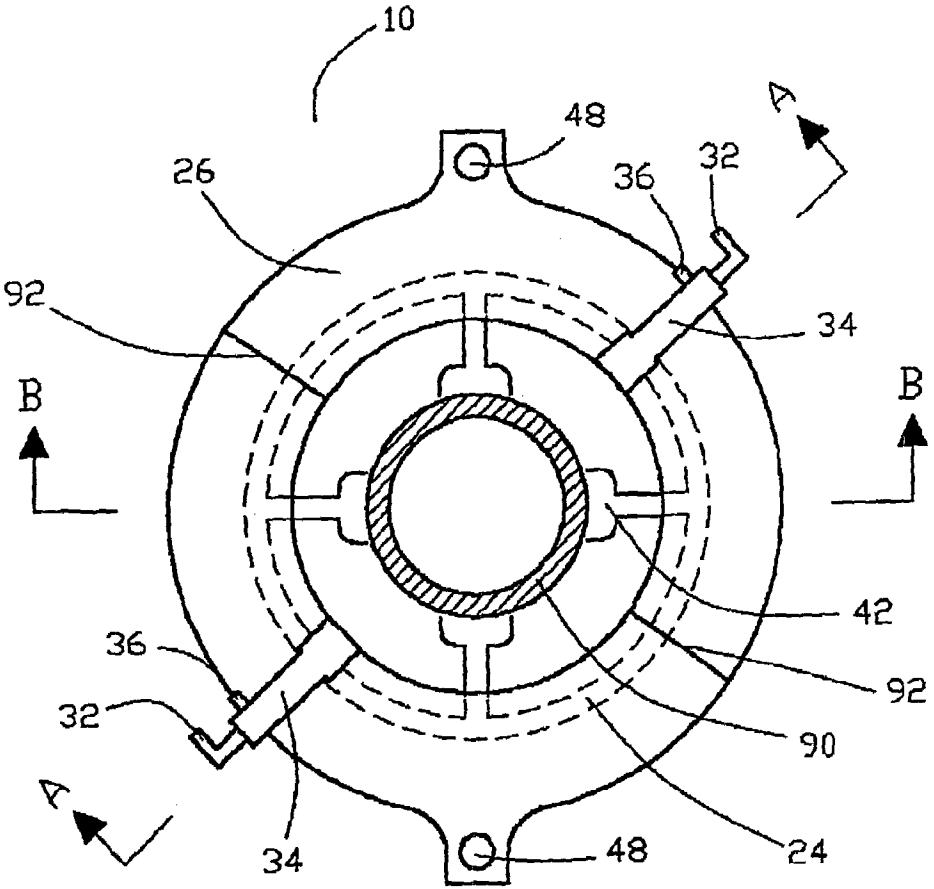
FIG. 1 is a front elevational view of one example of a coating apparatus of the present invention.
Figure 2:
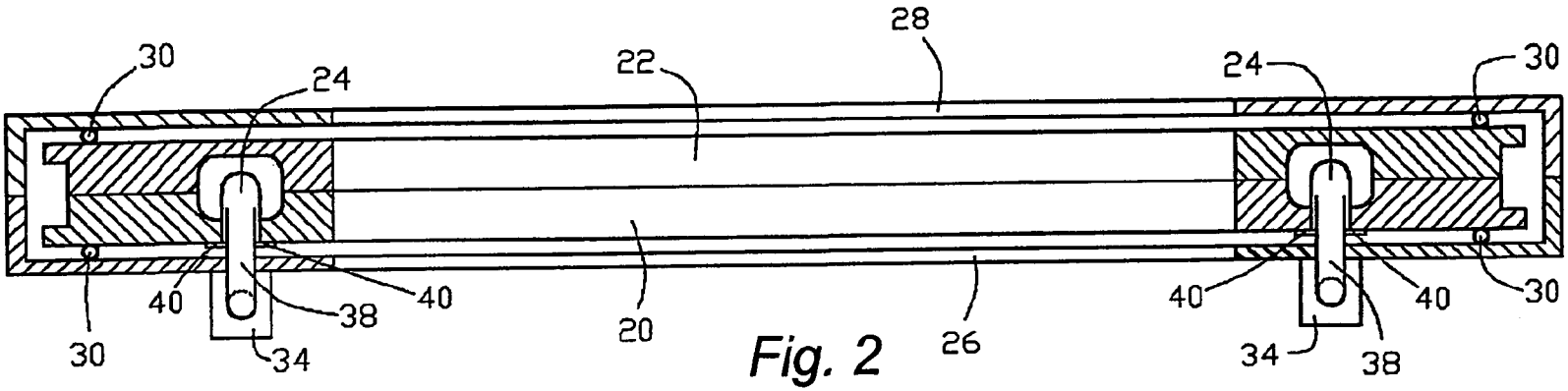
FIG. 2 is a cross-sectional view of a coating apparatus with sectioning plane defined by line A—A in FIG. 1

There is shown in FIG. 1 though FIG. 5 a first example of coating apparatus 10 of the present invention. Substantially annular rotor elements 20 and 22 are suitably joined together to form a rotor. Enclosed within the rotor is a gallery 24 (hidden and shown by dashed lines in FIG. 1) that extends substantially around the rotor. The rotor has a central axis that is common with the central axis of pipe 90 (shown in cross-section in FIG. 1). Stator elements 26 and 28 are disposed around the rotor and suitably joined together to form a stator. Means for providing free rotation of the rotor relative to the stator such as the ball bearings 30 shown in FIG. 2 are provided. Whilst the stator and rotor for the example in FIG. 1 are formed from two elements, they may be fabricated in different fashion to suit other materials and methods of assembly without deviating from the scope of the invention. Furthermore, whilst the stator in FIG. 1 is shown as a substantially annular structure, in other examples, the stator may be of another shape, such as rectangular. The stator and rotor may be machined from hard anodized aluminum and coated with a friction reducing material such as TEFLON to provide a favorable boundary surface in the internal passages as further described below.

As stated above, a suitable, but not limiting, coating material is a fusion-bonded epoxy in powdered form. The coating material is provided from an external source via a suitable pipe or tubing (not shown in the drawings) that is connected to material port 32 of vacuum displacement pump 34. Air port 36 on the pump is connected to a regulated compressed air supply (typically 30 psi for this example) by suitable pipe or tubing (not shown in the drawings). Regulating the supply of air to a venturi in pump 34 controls the intake draw of coating material into the coating apparatus and provides the means for keeping the coating material within the apparatus under positive air pressure. The term "fluidized" powder can be used to describe the coating material as it mixes with the injected air and reduces in density to a state suitable for passage within the coating apparatus of the present invention. A particular advantage of the present invention is that the non-rotating rotor provides a stationary structure for mounting each vacuum displacement pump. Therefore, the coating material and compressed air connections to each pump are not complicated by connecting to a rotating element.

Whilst the coating apparatus 10 shown in FIG. 1 uses two vacuum displacement pumps disposed on one of the two stator elements, other examples of the invention can have a different number of pumps that are attached to one stator face, or distributed between both stator faces.

Figure 3:
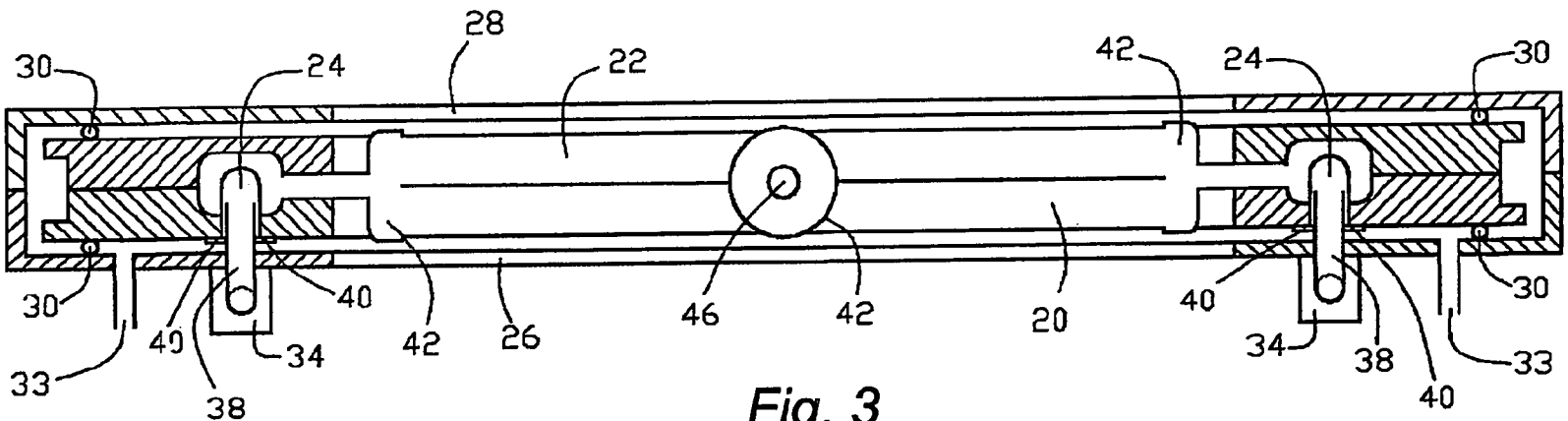
FIG. 3 is a cross-sectional view of a coating apparatus with sectioning plane defined by line B—B in FIG. 1

Pump outlet 38 injects the fluidized powder into gallery 24. Seals 40 serve as means to keep the powder within the gallery as the rotor rotates relative to the stator and pump outlet 38. The seals are designed to withstand the positive air pressure exerted on the powder within the gallery. As shown in FIG. 3, pressurized air may optionally be blown into one or more ports 33 on the rotor to assist in maintaining a positive air pressure on the seals 40.

Coating material is ejected from the gallery 24 through one or more coating heads 42 that are attached to the rotor and have an internal passage connected to the gallery. When the coating material is a thermoplastic material, pipe 90 will be preheated prior to the application of coating material to fuse the material onto the exterior surface of the pipe.

Optionally the exterior surface of pipe 90 can be grit blasted prior to coating by providing a suitable grit from an external source via a suitable pipe or tubing that is connected to material port 32 of one or more of the vacuum pumps 34. Alternatively one or more dedicated grit vacuum pumps can be provided around one or both of the stator faces.

As shown in FIG. 5, a coating head 42 can be provided with one or more interior diffusers 46 in the form of a disc or other shape to control the flow of coating material through the head and onto the exterior surface of the pipe. The coating head, including opening 44, can be configured as best to suit coating material ejection for a particular application. In the present example, diffuser 46 deflects the fluidized powder to the side wall 45 of the coating head so that the powder exits opening 44 in a generally uniform flow profile across the entire width of the opening. Preferably each coating head is removably attached to the rotor so that it can be removed and exchanged with a head of differing length, or fitted with a length extension fitting so that differing diameters of pipe can be accommodated.

Figure 4:
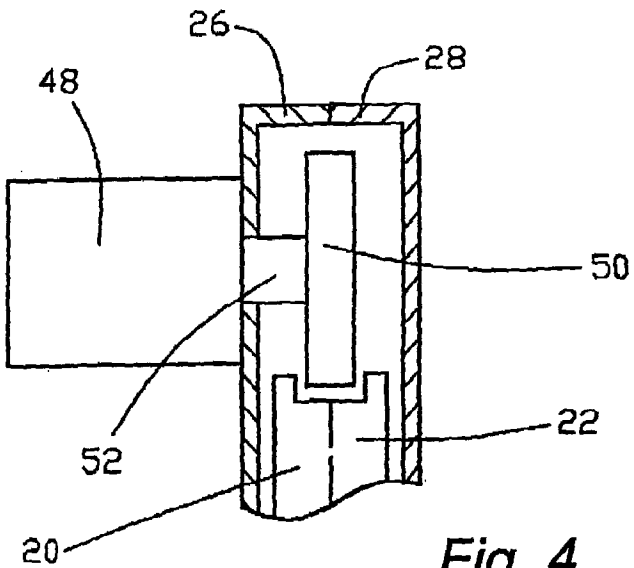
FIG. 4 is a side partial cross-sectional detail of one example of a means for driving the rotor of the coating apparatus shown in FIG. 1.

Suitable drive means are provided to rotate the rotor. One method of driving the rotor is shown in FIG. 4. Motor 48 is connected to sprocket 50 via output shaft 52. A chain (not shown in the drawings) engages sprocket 50 and radially projected teeth (not shown in the drawings) on the circular side surface of the rotor to deliver rotational power from the drive motor to the rotor. Whilst two motors are used in this example, a differing number and configuration may be used to suit a specific application.

In applications where the coating apparatus is slipped onto a section of pipe or slid along pipe sections as a pipeline is assembled, the stator and rotor can be formed as continuous elements around their circumferences. In other examples of the apparatus, the stator and rotor can include means for opening and closing around a section of pipe, such as two split or hinged members with interface boundaries 92 shown in FIG. 1.

Either the pipe or the coating device may be moved in its axial direction to effect coating along the length of the pipe. When the coating material is a thermoplastic material, pipe 90 will be preheated prior to the application of coating material to fuse the material onto the exterior surface of the pipe.

Optionally when application of a gas prior and during coating is desirable, the gas may be supplied to one or more of air ports 36 or one or more dedicated gas ports provided around one or both of the stator faces to inject the gas into gallery 24 prior and during coating. This is of particular value when polypropylene is the coating material and the gas is heated air that is applied prior and during coating.

Subsequent to coating, a quench fluid, either in liquid or gaseous form, can be supplied from an external source via a suitable pipe or tubing that is connected to material port 32 of one or more of the vacuum pumps 34. Alternatively one or more dedicated quench fluid pumps can be provided around one or both of the stator faces.

In applications where a combination of grit blasting and/or quenching are used, suitable valve arrangements can be provided upstream of the input to material port 32 to facilitate selection of the substance that is fed to the port.

Figure 7:
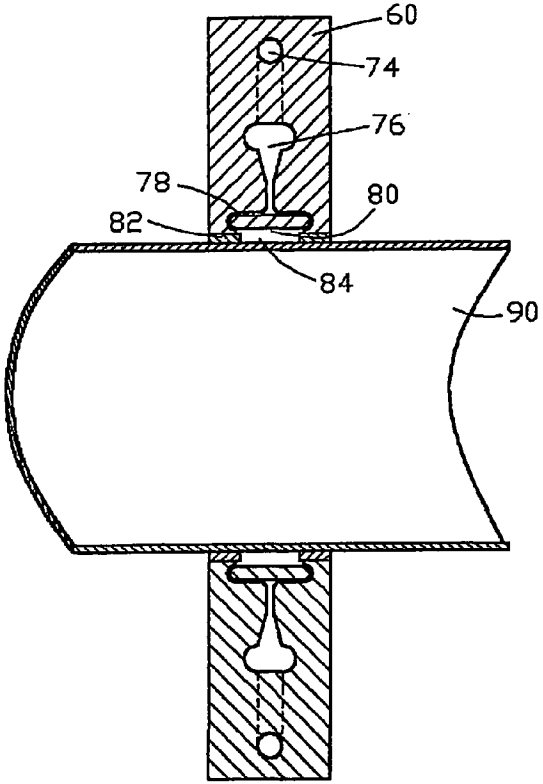
FIG. 7 is a cross-sectional view of the coating apparatus with sectioning plane defined by line C—C in FIG. 6.
Figure 6:
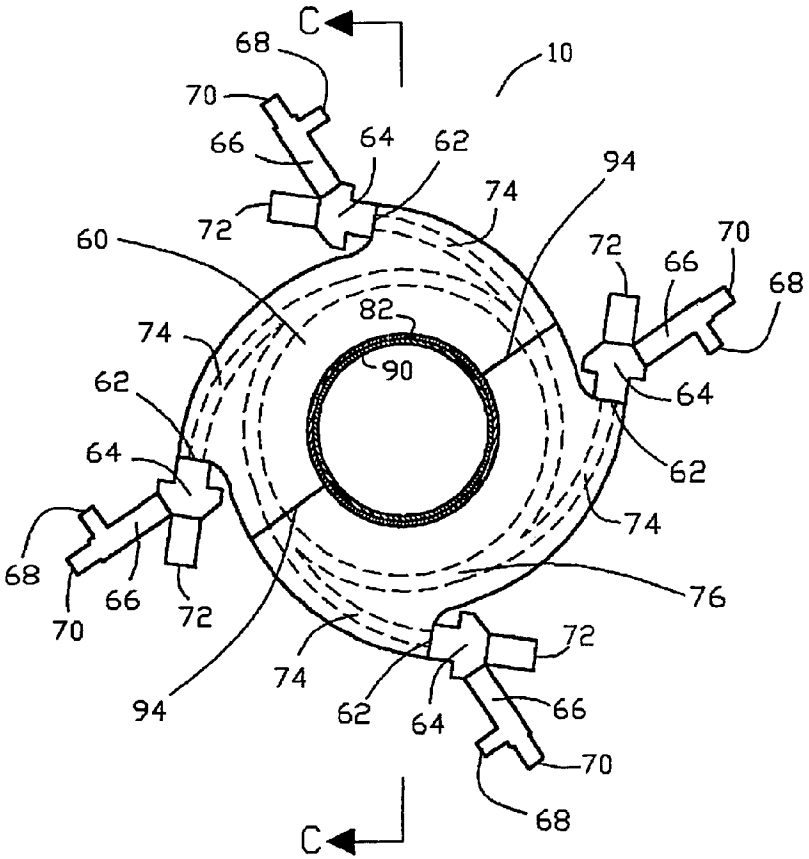
FIG. 6 is a front elevational view of another example of the coating apparatus of the present invention.

There is shown in FIG. 6 and FIG. 7 a second example of the coating apparatus 10 of the present invention. The apparatus comprises a substantially annular body 60, which has a plurality of entry ports 62 protruding from it. The number of entry ports for a particular application is governed by the diameter of the pipe 90 (shown in cross-section in FIG. 6 and FIG. 7) that is being coated and are, in general, symmetrically arranged around its outer perimeter. The annular body 60 can be formed from two machined halves.

Hard anodized aluminum is a suitable material. A coating of a friction reducing material such as TEFLON is preferable to provide a favorable boundary surface in the entry ports and other internal passages as further described below.

A mixing chamber 64 is connected to each of the entry ports. The mixing chamber is used as a means to introduce the coating material into the entry port at a positive air pressure. For this particular example, the coating material is introduced into the mixing chamber from fitting 66. Fitting 66 is attached to chamber 64 and has a material port 68 for connection to an external source of coating material via suitable pipe or tube (not shown in the drawings). Air port 70 in fitting 66 is connected to a regulated compressed air supply (generally with a range from 30 to 40 psi for the present example) by suitable pipe or tubing (not shown in the drawings). Regulating the supply of air to a venturi in fitting 66 controls the intake draw of coating material into the coating apparatus and provides the means for keeping the coating material (fluidized powder) within the apparatus under positive air pressure. Mixing chamber 64 has an air port 72 attached to it by which generally low pressure (in the range of 4 to 5 psi) and high volume (in the range of 20 to 25 cfm) air from a suitable source such as a low pressure air compressor (not shown in the figures) is supplied. The low-pressure air serves to force the coating material entering the mixing chamber from fitting 66 into entry port 62 and to further reduce the density of powder if required for a particular application.

Intake chamber 74 (hidden and shown as dashed lines in FIG. 6) within body 60 transfers the coating material from an entry port to compression chamber 76 that runs substantially around an inner diameter of body 60 (hidden and shown as dashed lines in FIG. 6). In this example, the intake chamber has a generally circular cross-section, and the compression chamber has a combination oval and funnel-shaped cross-section. Other shapes are suitable for the compression chamber as long as the chamber serves to compress the coating material under positive air pressure. The coating material is forced by air pressure down through compression chamber 76 and into diffusing chamber 78. In this example, the diffusing chamber is a substantially oval passage that opens into the sides of gallery 80. Interchangeable centre section 82 is a collar that is seated within the inner radial surface of annular body 60 to accommodate the outer diameter of the pipe 90 to be coated. One or more appropriate openings 84 are provided through the thickness of the centre section 82 to permit ejection of coating material onto the outer diameter of pipe 90. In the present example, opening 84 is a substantially continuous circumferential opening in the centre section to permit ejection of coating material 360 degrees around the perimeter of the pipe 90. In this manner, neither the pipe 90 nor coating device 10 need to be rotated to achieve a complete coating around the perimeter of the pipe. In alternative examples, satisfactory rotating means maybe provided with the coating device to rotate it if required for a particular coating process. Either the pipe or coating device may be moved in its axial direction to effect coating along the length of the pipe. When the coating material is a thermoplastic material, pipe 90 will be preheated prior to the application of coating material to fuse the material onto the exterior surface of the pipe.

The configuration of the coating apparatus 10 shown in FIG. 6 and FIG. 7, namely with four entry ports 62 arranged substantially 45 degrees apart from each other, can preferably (but not in limitation) be used to deposit a complete 360-degrees band of coating material around the exterior perimeter of a pipe having an outside diameter ranging from approximately 5 to 13 cm. For pipes of larger diameter, a greater number of entry ports can be used without deviating from the scope of the invention.

In applications where the coating apparatus shown in FIG. 6 and FIG. 7 is slipped onto a section of pipe or slid along pipe sections as a pipeline is assembled, body 60 can be formed as a continuous element around their circumferences. In other examples of the apparatus, the body can include means for opening and closing around a section of pipe, such as two split or hinged members with interface boundaries 94 shown in FIG. 6.

Options similar to those disclosed for the first example of the invention can be used for the second example of the invention shown in FIG. 6 and FIG. 7. Suitable grit can be provided to material port 68 of one or more of the fittings 66. Alternatively one or more dedicated grit material and entry ports can be provided around the perimeter of annular body 60 for injecting grit into compression chamber 76. A gas can be supplied to one or more air ports 70 prior and during coating. Alternatively one or more dedicated gas ports can be provided to inject the gas into the intake and compression chamber. A quench fluid can be provided to material port 68 of one or more of the fittings 66. Alternatively one or more dedicated quench fluid fittings can be provided around the perimeter of annular body 60.

In other examples of the invention, a magnetic induction heating assembly may be combined with the coating apparatus of the present invention to form a single stationary apparatus for preheating and coating around a complete circumferential area of the pipe.

The invention claimed is:

1. An apparatus for application of a coating material to the exterior surface of a pipe comprising:

a stator arranged in use to be disposed around the exterior surface of the pipe;

a substantially annular rotor rotationally disposed within the stator and arranged to have in use a common central axis with the pipe;

at least one gallery extending substantially around the axis, the at least one gallery internal to the rotor;

at least one coating head having an internal passage for the coating material and an opening arranged in use to be in close contact with the exterior surface of the pipe, the internal passage connected to the at least one gallery;

a drive means for rotating the rotor and the at least one coating head around the exterior of the pipe;

at least one outlet mounted on the stator and protruding laterally into the at least one gallery for injecting the coating material into the at least one gallery; and a means for applying positive air pressure to the at least one gallery, whereby the coating material is forced by air pressure through the at least one gallery and ejected onto the exterior surface of the pipe through the at least one coating head.

2. The apparatus of claim 1 further comprising at least one vacuum displacement pump attached to the stator, each of the at least one vacuum displacement pumps having a first input port for connection to a source of coating material, a second input port for connection to a source of compressed air, and an outlet port connected to the at least one outlet mounted on the stator.

3. The apparatus of claim 1 or 2 wherein sealing means are provided between the at least one gallery and the at least one outlet mounted on the stator to prevent release of the coating material from the at least one gallery.

4. The apparatus of claim 3 further comprising at least one air port in the stator, the air port connected to a pressurized air source whereby a positive air pressure is maintained on the sealing means.

5. The apparatus of claim 1 wherein the at least one coating head has a diffusing means within the internal passage of the at least one coating head.

6. The apparatus of claim 1 further comprising means for supplying a grit from an external source to the at least one gallery and means for applying positive air pressure to the at least one gallery, whereby the grit is forced by air pressure through the at least one gallery and ejected onto the exterior surface of the pipe through the at least one coating head.

7. The apparatus of claim 1 further comprising means for supplying a gas from an external source to the at least one gallery and means for applying positive air pressure to the at least one gallery, whereby the gas is forced by air pressure through the at least one gallery and ejected onto the exterior surface of the pipe through the at least one coating head.

8. The apparatus of claim 1 further comprising means for supplying a quench fluid from an external source to the at least one gallery and means for applying positive air pressure to the at least one gallery, whereby the quench fluid is forced by air pressure through the at least one gallery and ejected onto the exterior surface of the pipe through the at least one coating head.

9. The apparatus of claim 1 wherein the stator and the rotor include means for opening and closing around the pipe.

10. The apparatus of claim 1 further comprising at least one magnetic induction heater to heat the pipe prior to placement of the coating material onto the exterior surface of the pipe.

11. A method of applying a coating material to the exterior surface of a pipe comprising the following steps:

supplying at a positive air pressure the coating material to a stationary element surrounding the pipe;

transferring the coating material from the stationary element to a gallery within a rotating element disposed substantially within the stationary element via at least one outlet mounted on the stator and protruding laterally into the gallery, the gallery substantially surrounding the pipe; and ejecting the coating material onto the exterior surface of the pipe from a one or more coating heads having an internal passage connected to the gallery.

12. The method of claim 11 further comprising the following steps:

supplying at a positive air pressure a grit to the stationary element;

transferring the grit from the stationary element to the gallery; and ejecting the grit onto the exterior surface of the pipe from one or more coating heads.

13. The method of claim 11 further comprising the following steps:

supplying at a positive air pressure a gas to the stationary element;

transferring the gas from the stationary element to the gallery; and ejecting the gas onto the exterior surface of the pipe from one or more coating heads.

14. The method of claim 11 further comprising the following steps:

supplying at a positive air pressure a quench liquid to the stationary element;

transferring the quench liquid from the stationary element to the gallery; and ejecting the quench liquid onto the exterior surface of the pipe from one or more coating heads.

15. An apparatus for application of a coating material to the exterior surface of a pipe comprising:

a substantially annular-shaped body disposed around the exterior of the pipe;

at least one entry port peripherally disposed around the body, the entry port connected to a first end of an intake chamber disposed within the body;

a compression chamber disposed within the annular-shaped body and extending substantially around the radius of the pipe, a first end of the chamber connected to a second end of the intake chamber;

at least one diffusing chamber disposed within the annular-shaped body and extending substantially around the radius of the pipe, a first end of each the at least one diffusing chambers connected to a second end of the compression chamber;

a gallery disposed within the inner circumferential side of the annular-shaped body, a second end of each the at least one diffusing chambers opening into the gallery;

an interchangeable sleeve disposed against the inner circumferential side of the annular-shaped body, the interchangeable sleeve having one or more openings to the gallery;

means for supplying the coating material from an external source to each of the at least one entry ports; and means for applying positive air pressure to each of the at least one entry ports, whereby the coating material is forced under air pressure successively through the intake, compression and diffusing chambers, into the gallery and ejected through the one or more openings in the interchangeable sleeve onto the exterior surface of the pipe around the entire circumference of the pipe.

16. The apparatus of claim 15 wherein the means for supplying the coating material and the means for applying positive air pressure further comprises a mixing chamber attached to the entry port, the mixing chamber having a fitting connected to the external source of the coating material and a port to an external source of compressed air.

17. The apparatus of claim 15 wherein the annular-shaped body includes means for opening and closing around the pipe.

18. The apparatus of claim 15 further comprising means for supplying a grit from an external source to the at least one entry ports and means for applying positive air pressure to the at least one entry ports, whereby the grit is forced under air pressure successively through the intake, compression and diffusing chambers, into the gallery and ejected through the one or more openings in the interchangeable sleeve onto the exterior surface of the pipe around the entire circumference of the pipe.

19. The apparatus of claim 15 further comprising means for supplying a gas from an external source to the at least one entry ports and means for applying positive air pressure to the at least one entry ports, whereby the gas is forced under air pressure successively through the intake, compression and diffusing chambers, into the gallery and ejected through the one or more openings in the interchangeable sleeve onto the exterior surface of the pipe around the entire circumference of the pipe.

20. The apparatus of claim 15 further comprising means for supplying a quench liquid from an external source to the at least one entry ports and means for applying positive air pressure to the at least one entry ports, whereby the quench liquid is forced under air pressure successively through the intake, compression and diffusing chambers, into the gallery and ejected through the one or more openings in the interchangeable sleeve onto the exterior surface of the pipe around the entire circumference of the pipe.

21. The apparatus of claim 15 further comprising at least one magnetic induction heater to heat the pipe prior to placement of the coating material on to the exterior surface of the pipe.

22. A method of applying a coating material to the exterior surface of a pipe comprising the following steps:

supplying at a positive air pressure the coating material to an at least one intake chamber forming an arc-shaped path relative to the exterior surface of the pipe within a substantially annular-shaped, unitary body surrounding the pipe;

compressing the coating material received from the at least one intake chamber in a compression chamber substantially surrounding the exterior of the pipe within the substantially annular-shaped, unitary body;

diffusing the coating material exiting the compression chamber in an at least one diffusing chamber arranged annularly around the exterior of the pipe and substantially surrounding the exterior of the pipe within the substantially annular-shaped, unitary body; and ejecting the coating material from the at least one diffusing chamber onto the exterior surface of the pipe.

23. The method of claim 22 further comprising the following steps:

supplying at a positive air pressure a grit to the at least one intake chamber;

compressing the grit received from the at least one intake chamber in the compression chamber;

diffusing the grit exiting the compression chamber in the at least one diffusing chamber;

injecting the grit exiting the compression chamber into the gallery; and ejecting the grit from the at least one diffusing chamber onto the exterior surface of the pipe.

24. The method of claim 22 further comprising the following steps:

supplying at a positive air pressure a gas to the at least one intake chamber;

compressing the gas received from the at least one intake chamber in the compression chamber;

diffusing the gas exiting the compression chamber in the at least one diffusing chamber;

injecting the gas exiting the compression chamber into the gallery; and ejecting the gas from the compression chamber onto the exterior surface of the pipe.

25. The method of claim 22 further comprising the following steps:

supplying at a positive air pressure a quench liquid to the at least one intake chamber;

compressing the quench liquid received from the at least one intake chamber in the compression chamber;

diffusing the quench liquid exiting the compression chamber in the at least one diffusing chamber;

injecting the quench liquid exiting the compression chamber into the gallery; and ejecting the quench liquid from the compression chamber onto the exterior surface of the pipe.

* * * * *